US008051848B2

(12) United States Patent
Maeda

(10) Patent No.: US 8,051,848 B2
(45) Date of Patent: Nov. 8, 2011

(54) TOY GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 12/801,416

(22) Filed: Jun. 8, 2010

(65) Prior Publication Data

US 2010/0319668 A1 Dec. 23, 2010

(30) Foreign Application Priority Data

Jun. 22, 2009 (JP) ..... 2009-147467

(51) Int. Cl.
*F41B 11/00* (2006.01)

(52) U.S. Cl. ..... 124/75

(58) Field of Classification Search ..... 124/71–77; 89/129.01, 129.02
See application file for complete search history.

(56) References Cited

U.S. PATENT DOCUMENTS

| | | | | | |
|---|---|---|---|---|---|
| 1,425,809 | A | * | 8/1922 | Thompson | 89/187.01 |
| 2,509,530 | A | * | 5/1950 | Rosengren et al. | 89/130 |
| 2,976,771 | A | * | 3/1961 | Lambert | 89/129.02 |
| 3,204,529 | A | * | 9/1965 | Silsby | 89/140 |
| 3,292,492 | A | * | 12/1966 | Sturtevant | 89/128 |
| 3,345,914 | A | * | 10/1967 | Newcomb et al. | 89/129.02 |
| 3,774,500 | A | * | 11/1973 | Into | 89/129.01 |
| 4,004,496 | A | * | 1/1977 | Snodgrass et al. | 89/129.02 |
| 4,594,934 | A | * | 6/1986 | Holstein et al. | 89/129.02 |
| 4,941,394 | A | | 7/1990 | Zedrosser et al. | |
| 5,413,083 | A | | 5/1995 | Jones | |

FOREIGN PATENT DOCUMENTS

| | | | |
|---|---|---|---|
| DE | 677817 | C | 7/1939 |
| DE | 699534 | C | 12/1940 |
| EP | 0 362 188 | A2 | 4/1990 |
| JP | 08-145599 | A | 6/1996 |
| JP | 2007-101015 | A | 4/2007 |

OTHER PUBLICATIONS

Extended European Search Report, App. No. 10005243.0-1260, Jul. 29, 2010 (7 pages).

* cited by examiner

*Primary Examiner* — Troy Chambers

(57) ABSTRACT

A trigger sear is placed between a trigger and a bolt sear. The engagement between the bolt sear and a bolt is removed by pulling the trigger. The bolt makes reciprocating motion in the back and forth direction of the toy gun. While it reciprocates once, the bolt opens and closes a valve portion and fires off a bullet B. When the trigger is pulled, a stopper pawl and a driving pawl are engaged with a control plate having a ratchet gear structure. In conjunction with the reciprocating motion of the bolt, the driving pawl rotates and displaces the control plate in a forward direction. When the toy gun fires a predetermined number of bullets B, a sear bar is displaced. The sear bar moves the trigger sear and causes it to break away from the bolt sear.

3 Claims, 11 Drawing Sheets

TOY GUN

CROSS REFERENCE TO RELATED APPLICATION

The present application is based on and claims the benefit of priority of Japanese Patent Application No. 2009-147467 filed on Jun. 22, 2009, the entire contents of which is incorporated herein by reference.

TECHNICAL FIELD

The present invention relates to a burst toy gun so configured that pressure arising from compressed gas is applied to a bullet to fire it off by a user pulling the trigger.

BACKGROUND

There are conventionally burst toy guns used by toy gun enthusiasts for fun in target shooting (plinking) or the like at home. "Burst" cited here refers to continuously firing off a predetermined number of multiple bullets each time a trigger is pulled once. For example, the electric gun described in Japanese Unexamined Patent Publication No. 2007-101015 includes: a motor that drives a sector gear; a switching portion that energizes this motor; and a counter for specifying the number of times of continuously firing off bullets. The user of this electric gun specifies a desired number of times of continuous firing by the counter in advance. When the user pulls an operating element (trigger) in this state, the motor is driven and the electric gun continuously fires off bullets by the specified number of times of continuous firing. The toy gun described in Japanese Unexamined Patent Publication No. Hei 8 (1996)-145599 is an air gun that uses compressed gas to fire off bullets. This toy gun operates as described below. When the user pulls the trigger of the toy gun described in Japanese Unexamined Patent Publication No. Hei 8 (1996)-145599, a sear that has locked a hammer is moved. As a result, the engagement between the hammer and the sear is removed and the hammer hits a discharge valve to open the valve. Then the gas whose pressure has been accumulated is discharged and a bullet is fired off. About that time, a slide is moved backward by the pressure of the gas. Then the slide is abutted against the hammer and rotates it. This raises the hammer. In this toy gun, further, the slide moves backward and is abutted against a first lever and rotates it downward. A hook bar engaged with a notch of a counter plate is rotated simultaneously with the backward movement of the slide and is shifted to the next notch and engaged with the notch. As a result, the counter plate is pushed down. In the toy gun described in Japanese Unexamined Patent Publication No. Hei 8 (1996)-145599, the above action is repeated each time blowback occurs. When a predetermined number of times of blowback ends, the sear locks the hammer and the engagement between the notch of the counter plate and the hook bar is released. This completes a burst.

However, such toy guns as the electric gun described in Japanese Unexamined Patent Publication No. 2007-101015 are equipped with components such as a battery, circuit, motor, and the like and this increases their manufacturing cost.

Further, toy guns so configured as to electrically fire off bullets such as BB bullets are weak in impact for firing off bullets. For this reason, a user using such a toy gun cannot obtain satisfaction that will be obtained when the user feels as if he/she used a real gun. The toy gun described in Japanese Unexamined Patent Publication No. Hei 8 (1996)-145599 uses compressed gas to fire off bullets and is superior to the toy gun in Japanese Unexamined Patent Publication No. 2007-101015 in that a user can feel as if he/she used a real gun. However, the gun described in Japanese Unexamined Patent Publication No. Hei 8 (1996)-145599 also involves a problem. The number of times of firing is controlled by pushing down the counter plate and this makes its mechanism vertically long and poses limitation on product designs.

SUMMARY

Accordingly, an object of the present invention is to realize a burst toy gun that allows a user to feel as if he/she used a real gun in burst firing and reduces design limitations.

According to the present invention, A burst toy gun includes a trigger so provided that the trigger can be freely displaced between a firing position for firing off a bullet and a non-firing position, a valve portion opening and closing an area where a barrel and an air chamber filled with compressed gas communicate with each other, a bolt slidably provided, making reciprocating motion upon receiving power supplied by a power supplying portion, and opening and closing the valve portion while the bolt reciprocates once, a bolt sear so provided that the bolt sear can be freely displaced between an arrest position where the reciprocating motion of the bolt is arrested and a permission position where this reciprocating motion is permitted, a rotary member so provided that the rotary member can be freely rotated both in a forward direction and in a backward direction, a reverse rotation prevention unit provided so that the reverse rotation prevention unit can freely come close to and break away from the rotary member, and permitting the rotation of the rotary member in the forward direction and arresting the rotation in the backward direction when the reverse rotation prevention unit is close to the rotary member, a rotational force supplying portion supplying the rotary member rotationally displaced in the forward direction with rotational force in the backward direction for returning the rotary member to an initial position, a bolt action transmission unit provided so that the bolt action transmission unit can freely come close to and break away from the rotary member, making reciprocating motion according to the reciprocating motion of the bolt when the bolt action transmission unit is close to the rotary member, and rotationally displacing the rotary member in the forward direction during this process, a trigger action transmission unit causing the reverse rotation prevention unit and the bolt action transmission unit to come close to the rotary member according to displacement of the trigger to the firing position and causing the reverse rotation prevention unit and the bolt action transmission unit to break away from the rotary member according to displacement of the trigger to the non-firing position, and a bolt stop unit positioning the bolt sear in the permission position according to displacement of the trigger to the firing position and positioning the bolt sear in the arrest position according to at least either of displacement of the trigger to the non-firing position and rotational displacement of the rotary member from the initial position due to a predetermined number of times of the reciprocating motion of the bolt action transmission unit.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Description will be given to an embodiment with reference to FIG. 1 to FIG. 11.

Figure 1:
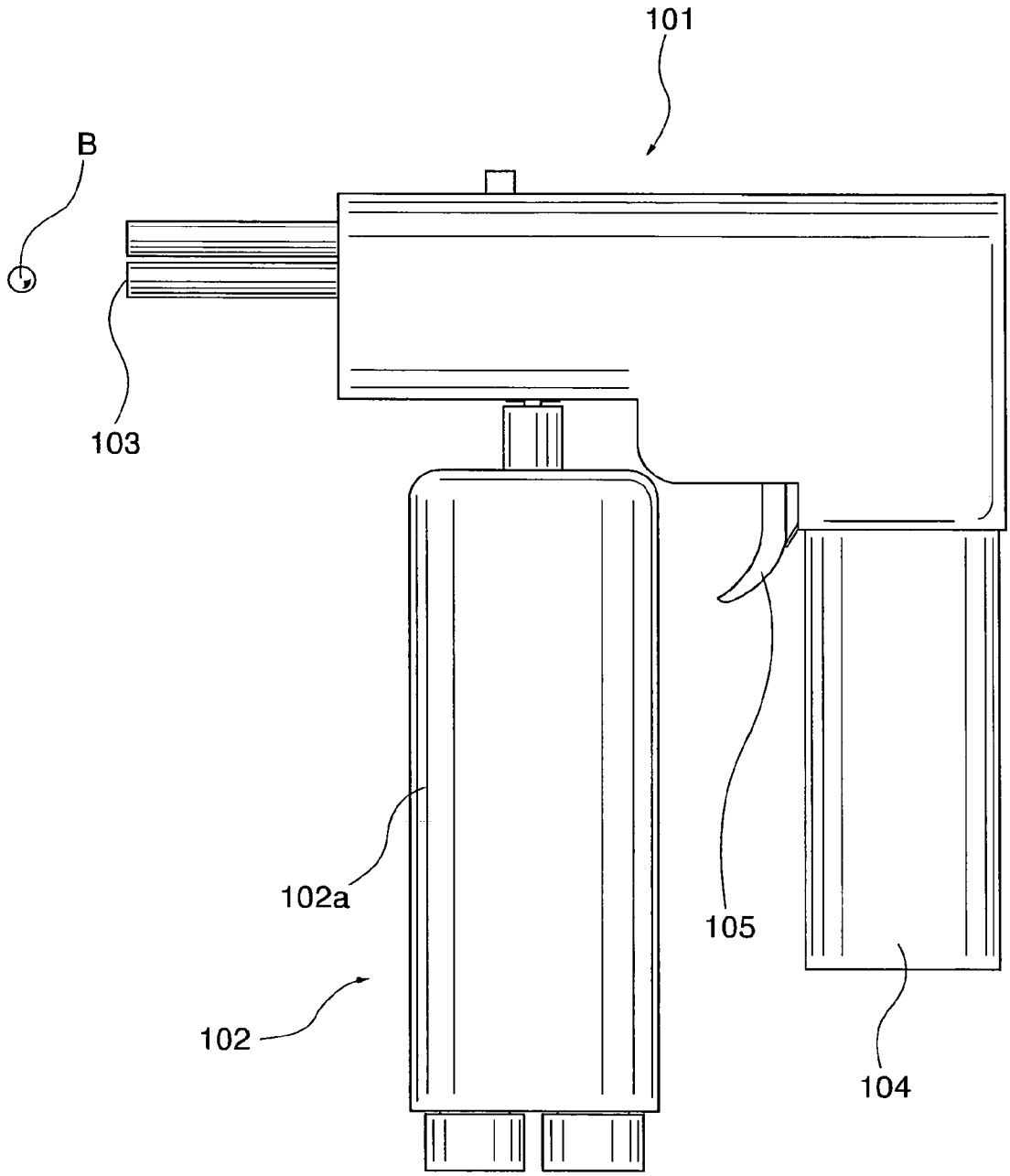
FIG. 1 is a left side view of a toy gun.

FIG. 1 is a left side view of a toy gun 101. The toy gun 101 in this embodiment is used with a compressed gas cylinder 102 attached thereto. In the toy gun 101, the pressure of compressed gas filled in the compressed gas cylinder 102 is applied to a bullet B and the bullet B is fired off from a muzzle 103. The compressed gas cylinder 102 is used with a gas cartridge 102*a* loaded. This gas cartridge 102*a* is attached to the toy gun 101. The compressed gas cylinder 102 supplies gas to the toy gun 101 through the gas cartridge 102*a*. When the gas cartridge 102*a* is loaded into the compressed gas cylinder 102, gas in the compressed gas cylinder 102 becomes apt to immediately flow out. However, the gas cartridge 102*a* is provided with a regulator (not shown). For this reason, the gas does not flow out of the gas cartridge unless the gas cartridge is loaded to the toy gun 101. To use the toy gun 101, a user grasp its grip 104 with his/her hand and puts his/her finger on the trigger 105 and aims the muzzle 103 at a shooting target (for example, a mark). Then the user can fire off a bullet B from the muzzle 103 by moving his/her finger to pull the trigger 105 to the rear side of the toy gun 101.

Figure 2:
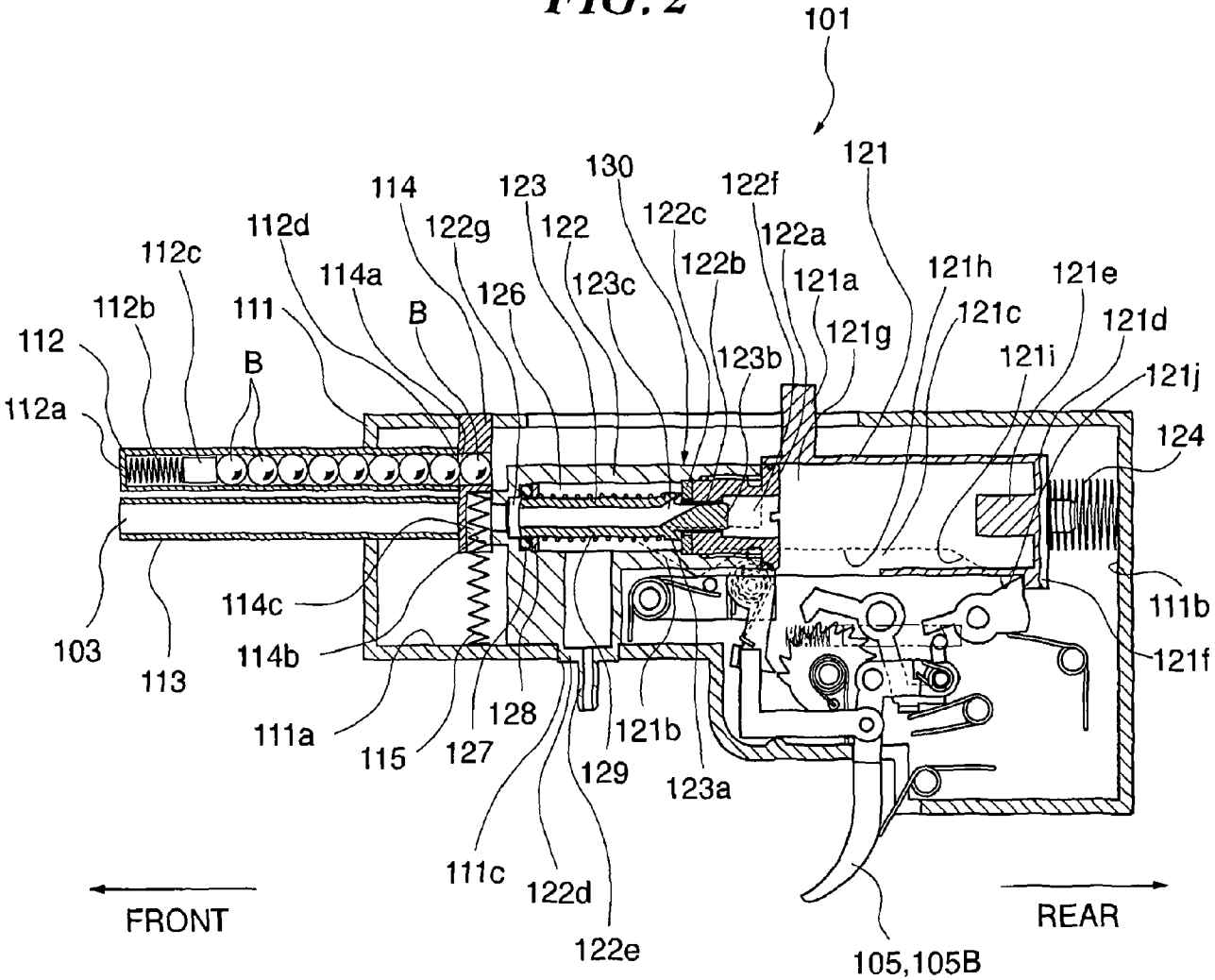
FIG. 2 is a left sectional view illustrating the internal structure of a toy gun.

FIG. 2 is a left sectional view illustrating the internal structure of the toy gun 101. In FIG. 2 and FIG. 7 to FIG. 11, the compressed gas cylinder 102 and the grip 104 are omitted. In the following description, the side on which the muzzle 103 is positioned will be designated as the front side of the toy gun 101 and the side on which the grip 104 is positioned will be designated as the rear side of the toy gun 101.

First, description will be given to each part provided in the front part of the toy gun 101. The toy gun 101 includes a frame 111 that forms an enclosure, a magazine 112, a barrel 113, and a bullet feed plate 114. In this embodiment, the magazine 112 and the barrel 113 are protruded from the frame 111 forward of the toy gun 101. The magazine 112 and the barrel 113 may be housed in the frame 111.

The magazine 112 is a cylindrical member with one end being a closed end 112*a* and is capable of housing bullets B therein. A magazine spring 112*b* is attached to the inner surface of the closed end 112*a* in the magazine 112. At the end of the magazine spring 112*b* on the opposite side to the closed end 112*a*, a magazine follower 112*c* that pushes bullets B is attached. Bullets B are guided into the magazine 112 through an opening (not shown) provided in the magazine 112. The magazine 112 with bullets B housed therein is attached to the front side of the frame 111 with its open end 112*d* pointed backward of the toy gun 101. In this embodiment, the magazine 112 is fixed in the frame 111. The magazine 112 may be detachable from the frame 111.

The barrel 113 is a cylindrical member. The front end of the barrel 113 is the muzzle 103. The inside diameter of the barrel 113 is substantially the same as the diameter of each bullet B. The barrel 113 is positioned under the magazine 112 on the front side of the frame 111.

The bullet feed plate 114 is a flat plate-like member. The bullet feed plate 114 is placed in the frame 111 so that it is oriented orthogonally to the magazine 112. The bullet feed plate 114 is supported by a guide member (not shown) placed in the frame 111 and can be moved in the vertical direction. The open end 112*d* face of the magazine 112 attached to the frame 111 and the open end 103*a* face of the barrel 113 on the opposite side to the muzzle 103 are abutted against the surface of the bullet feed plate 114 facing forward.

The bullet feed plate 114 has a bullet retention hole 114*a* in a position opposite the open end 112*d* of the magazine 112. This bullet retention hole 114*a* is a hole in a size sufficient to house a bullet B. The lower end face of the bullet feed plate 114 is coupled to a bullet feed plate spring 115. The other end of the bullet feed plate spring 115 on the opposite side to the bullet feed plate 114 is coupled to the inner bottom face 111*a* of the frame 111. The bullet feed plate spring 115 pushes the bullet feed plate 114 upward and positions the bullet retention hole 114*a* in the position opposite the open end 112*d* of the magazine 112.

The bullet feed plate 114 has a slope 114*b* at its lower part. The slope 114*b* is inclined so that it ascends from the rear to the front of the toy gun 101. The bullet feed plate 114 has a space 114*c* through which the tip portion of a bolt 121 (described later) can pass above the slope 114*b*.

A bullet B in the magazine 112 attached to the frame 111 is pushed out by the magazine follower 112*c* due to the biasing force of the magazine spring 112*b*. It is then housed in the bullet retention hole 114*a* in the bullet feed plate 114. When the bolt 121 advances forward and pushes the bullet feed plate 114 downward, the bullet B is positioned in a position opposite the open end 103*a* of the barrel 113. (Refer to FIG. 8.) When a discharge valve 123 (described later) jets out compressed gas forward in this state, the bullet B is pushed out forward. It passes through the interior of the barrel 113 and is shot forward out of the muzzle 103. (Refer to FIG. 9.)

Description will be given to each part provided in the middle of the toy gun 101 with reference to FIG. 2. The toy gun 101 has in the frame 111 the bolt 121, a valve body 122, the discharge valve 123, a bolt spring 124 as a power supplying portion, packing 122*c*, and the discharge valve spring 129. Of these elements, the discharge valve 123, packing 122*c*, and discharge valve spring 129 form a valve portion 130 that opens and closes the area where the barrel 113 and an air chamber 126 (described later) communicate with each other. The bolt 121 opens and closes this valve portion 130 while it reciprocates once in the back and forth direction.

The bolt 121 is a cylindrical member extended in the back and forth direction of the toy gun 101. The bolt 121 is so provided that it can freely slide in the back and forth direction of the toy gun 101. The front part of the bolt 121 is an open end 121*g*. The rear part of the bolt 121 is a closed end 121*d*. The bolt 121 has a protruded portion 121*a* protruded upward from its upper surface. The lower part of the bolt 121 on the open end 121*g* side is extended forward. The bolt 121 has a forward slope 121*b* on the under surface of this portion extended forward. The forward slope 121*b* is inclined upward as it goes from the rear to the front. One end of the bolt spring 124 is abutted against the closed end 121*d* of the bolt 121. The other end of the bolt spring 124 is abutted against the inner surface 111*b* of the rear part of the frame 111. The bolt spring 124 applies thrust to the bolt 121 for pushing it forward. When the bolt spring 124 pushes the bolt 121 forward, the bolt 121 is caused to slide forward. Then the bolt brings the forward slope 121*b* of the bolt 121 into slide contact with the slope 114*b* of the bullet feed plate 114 to push the bullet feed plate 114 downward. Though detailed description will be described later, the bolt 121 that moved forward and pushed the bullet feed plate 114 downward makes the following movement: the bolt receives the pressure of compressed gas passing through an air gap S (described later) between the inner circumferential surface of a through hole 122*b* and a slide projection 123*b* and moves backward. The bolt 121 makes reciprocating motion and repeats the forward movement and the backward movement as mentioned above.

The bolt 121 is provided in its side surface with a cam groove 121*c*. The cam groove 121*c* is directed backward from the portion of the toy gun 101 extended forward. The depth (distance from the under surface of the bolt 121) of the cam groove 121*c* is not even as illustrated in FIG. 2. More specifically, the cam groove 121*c* has a forward flat portion 121*h*, a backward slope 121*i*, and a backward flat portion 121*j* that continue from the front to the rear in this order. Further, the bolt 121 has a locking projection 121*f*. The locking projection 121*f* is extended downward from the under surface on the closed end 121*d* side. On the inner surface side of the closed end 121*d* of the bolt 121, a fitting projection 121*e* is protruded. The fitting projection 121*e* is fit into a fitting hole 122*f* (described next) located at the rear end of the valve body 122.

The valve body 122 is a cylindrical member. The valve body 122 is provided in the frame 111 so that it is fixed. The outside diameter of the valve body 122 is smaller than the inside diameter of the bolt 121. When the bolt 121 advances, the valve body 122 enters through the open end 121*g* of the bolt 121. In the area at the front part of the toy gun 101 in the space in the valve body 122, a space 122*g* is ensured for the discharge valve 123 (described later) to slide and move forward. A rear lid 122*a* is installed at the rear end of the valve body 122. The rear lid 122*a* has a through hole 122*b* for letting the exterior of the valve body 122 and the interior of the discharge valve 123 communicate with each other. The rear part of the through hole 122*b* is increased in inside diameter and forms the fitting hole 122*f*. The fitting projection 121*e* provided on the bolt 121 is fit into this fitting hole 122*f* from outside the valve body 122. In addition, a slide projection 123*b* (described later) provided on the discharge valve 123 enters this through hole 122*b* from inside the valve body 122. This slide projection 123*b* is protruded to the fitting hole 122*f* side. The rear lid 122*a* has the ring-shaped packing 122*c* attached to its end face facing forward.

The valve body 122 has a gas introducing portion 122*d*. The gas introducing portion 122*d* is protruded downward form the under surface of the valve body 122. The gas introducing portion 122*d* is hollow and lets the space in the valve body 122 and the space outside the frame 111 communicate with each other. The gas introducing portion 122*d* is fit into an attachment hole 111*c* formed in the inner bottom face 111*a* of the frame 111. As a result, the tip 122*e* of the gas introducing portion 122*d* is protruded downward of the frame 111. The compressed gas cylinder 102 (not shown in FIG. 2) is attached to this tip 122*e* of the gas introducing portion 122*d*. The compressed gas cylinder 102 feeds compressed gas into the valve body 122 through this gas introducing portion 122*d*.

The discharge valve 123 is a cylindrical member and its front end face is open. The outside diameter of the discharge valve 123 is smaller than the inside diameter of the valve body 122. This discharge valve 123 is positioned in the valve body 122 and forms the air chamber 126 between the valve body 122 and the discharge valve 123.

Figure 3:
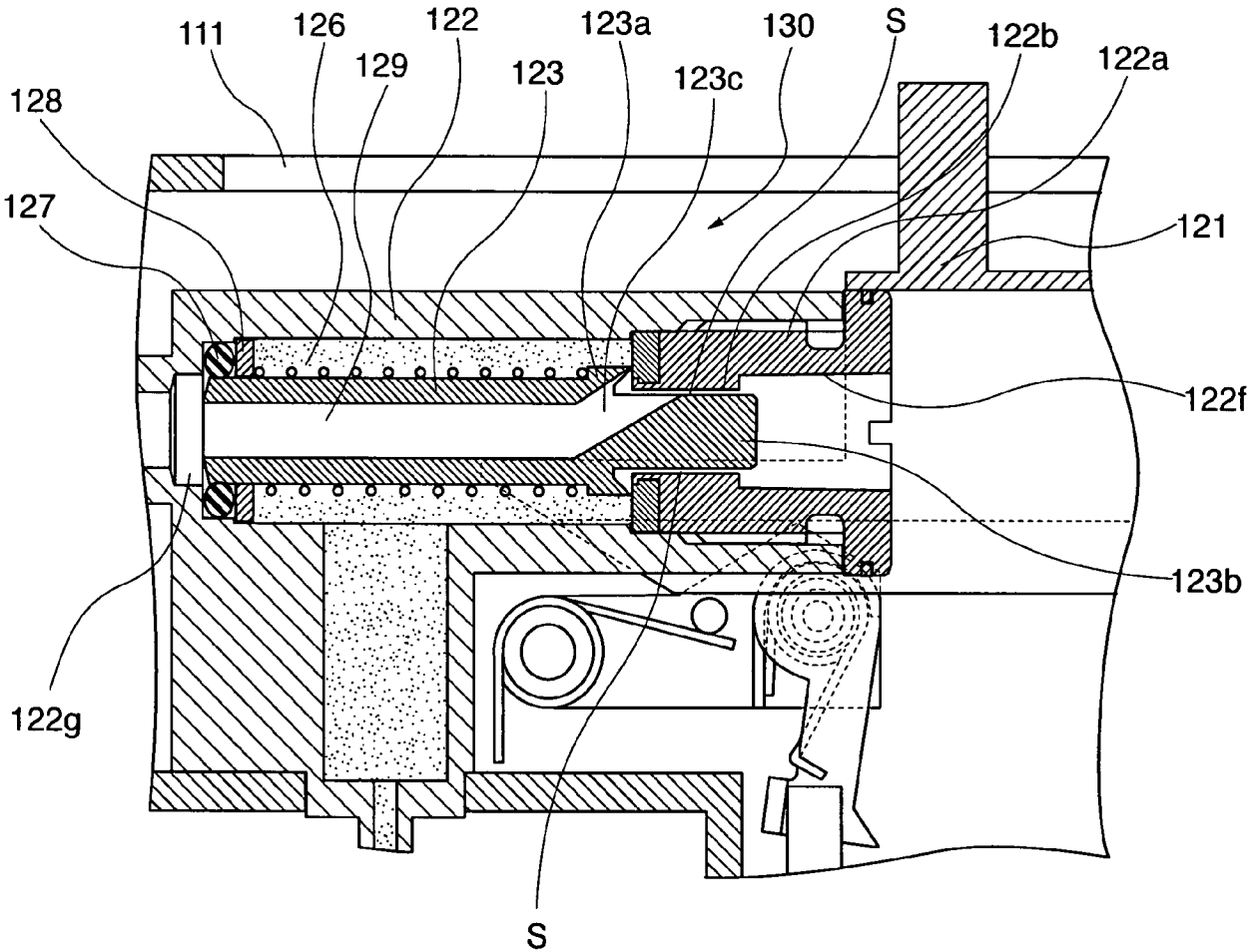
FIG. 3 is a left side view illustrating a valve portion as is closed.

FIG. 3 is a left side view illustrating the valve portion 130 as is closed. The dot meshed portions in FIG. 3 indicate areas filled with compressed gas. The discharge valve 123 comprising the valve portion 130 has a flange portion 123*a* and the slide projection 123*b* at its rear end area. The flange portion 123*a* is protruded from the outer circumferential surface of the discharge valve 123 in the radial direction. The slide projection 123*b* is protruded from the rear end face of the discharge valve 123. The slide projection 123*b* has a shape that allows it to enter the through hole 122*b* in the rear lid 122*a*. When the slide projection 123*b* enters the through hole 122*b*, it forms the air gap S between it and the inner circumferential surface of the through hole 122*b*.

The discharge valve 123 has a communicating passage 123*c*. The communicating passage 123*c* is a cylindrical space inclined from the direction in which the internal space of the discharge valve 123 is extended. One end of the communicating passage 123*c* communicates with the internal space of the discharge valve 123. An opening at the other end of the communicating passage 123*c* appears between the flange portion 123*a* and the slide projection 123*b*.

In the front end area of the outer circumferential surface of the discharge valve 123, an O-ring 127 and a washer 128 are installed. As illustrated in FIG. 2, the O-ring 127 is sandwiched between the washer 128 and the inner wall of the valve body 122. The washer 128 is positioned next to the rear part of the O-ring 127. One end of the discharge valve spring 129 is brought into contact with the rear surface of the washer 128. The discharge valve spring 129 is placed so that it is wound around the discharge valve 123. The other end of the discharge valve spring 129 is brought into contact with the flange portion 123*a* of the discharge valve 123. The discharge valve spring 129 pushes the washer 128 and thereby presses the O-ring 127 against the inner wall of the valve body 122. Further, the discharge valve spring 129 presses the flange portion 123*a* of the discharge valve 123 against the packing 122*c* to make the air chamber 126 air-tight. In this state, gas introduced from the gas introducing portion 122*d* into the air chamber 126 does not leak from the front part or rear part of the valve body 122.

Figure 4:
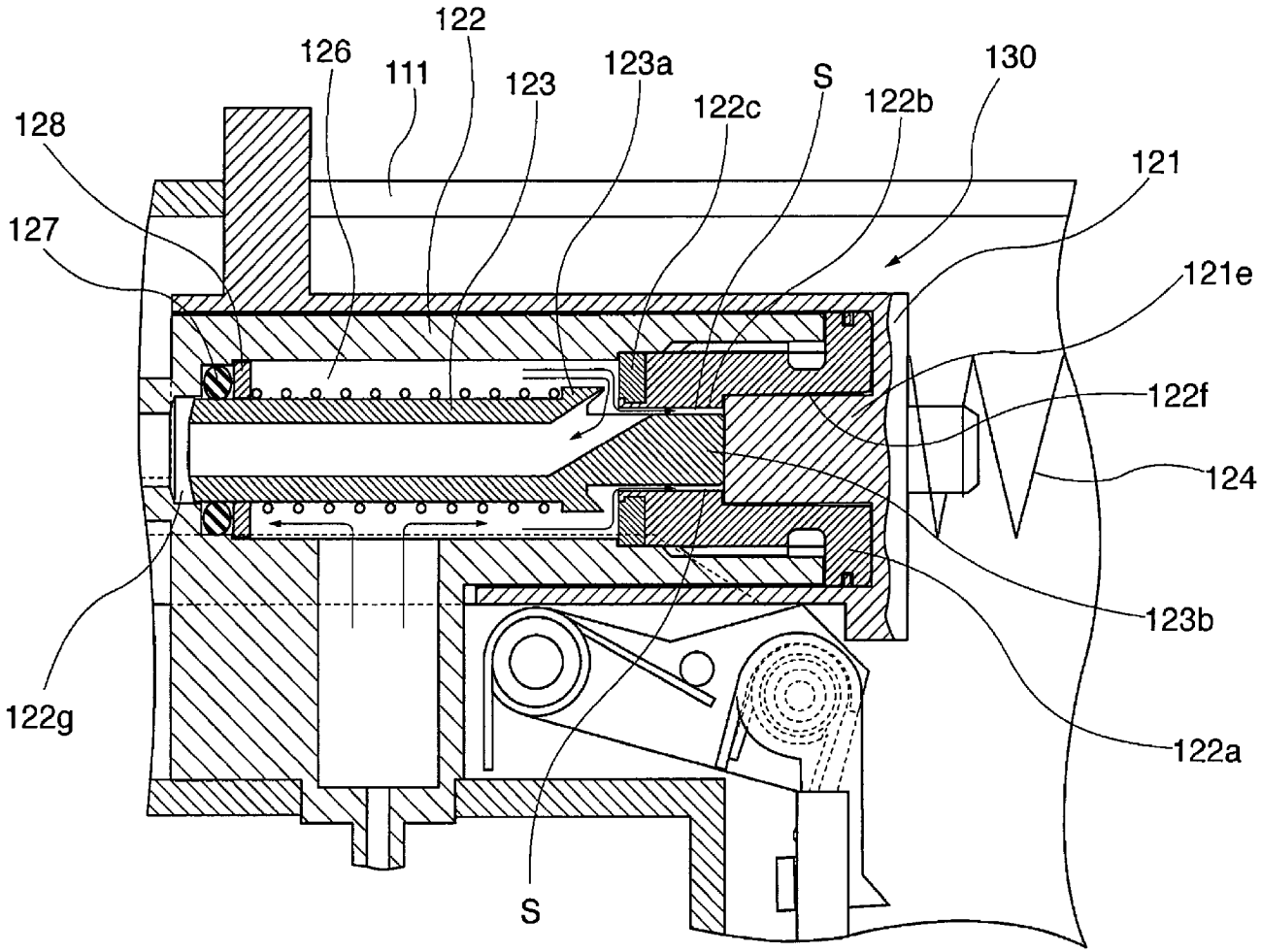
FIG. 4 is a left side view illustrating a valve portion as is open.

FIG. 4 is a left side view illustrating the valve portion 130 as is open. The arrows in FIG. 4 indicate the movement of compressed gas. When the fitting projection 121*e* of the bolt 121 pushes the slide projection 123*b* forward, the discharge valve 123 jets out gas from its front part to apply pressure to a bullet B. More specific description will be given. When the bolt 121 is pushed by the bolt spring 124 and slides forward, the fitting projection 121*e* of the bolt 121 enters the fitting hole 122*f* and pushes the slide projection 123*b* forward. This causes the discharge valve 123 to slide toward the space 122*g* in the valve body 122. As a result, the flange portion 123*a* of the discharge valve 123 breaks away from the packing 122*c*. The compressed gas filled in the air chamber 126 flows into the internal space of the discharge valve 123 through a gap formed between the flange portion 123*a* and packing 122*c* as indicated by arrows in FIG. 4. Then it is jetted forward out of the discharge valve 123 and pushes out the bullet B.

Further, when the flange portion 123*a* and the packing 122*c* break away from each other, the compressed gas also enters the air gap S and passes through the through hole 122*b* as indicated by arrows in FIG. 4. This compressed gas hits against the fitting projection 121*e* of the bolt 121 and the inner surface 111*b* (Refer to FIG. 2) of the rear part of the bolt 121 and pushes the bolt 121 backward.

When the discharge valve 123 moves forward, the discharge valve spring 129 pushes back the discharge valve 123. This causes the discharge valve 123 to slide backward and the flange portion 123*a* is brought into tight contact with the packing 122*c*. As a result, the air chamber 126 becomes air-tight again. In the air-tight state, the air chamber 126 is filled with compressed gas supplied from the compressed gas cylinder 102.

Figure 5:
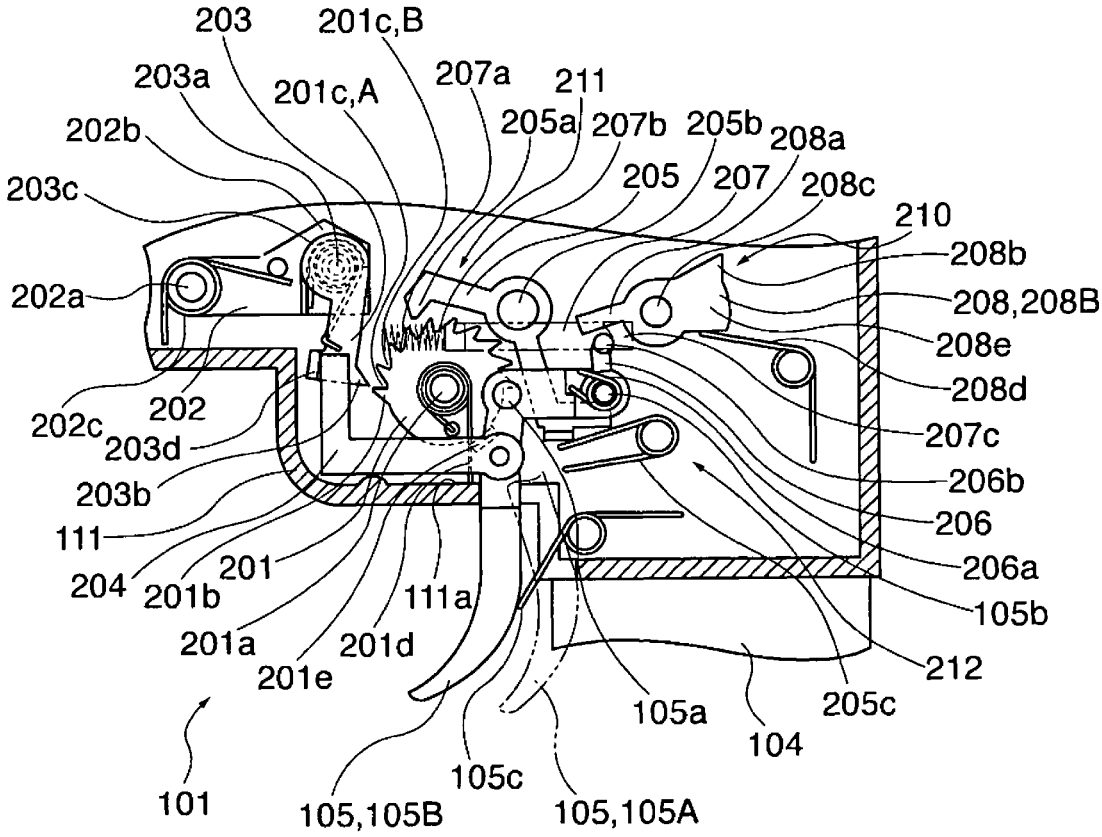
FIG. 5 is a left side view illustrating the internal structure of the area in proximity to the trigger of a toy gun in an enlarged manner.

FIG. 5 is a left side view illustrating the internal structure of the area in proximity to the trigger 105 of the toy gun 101 in an enlarged manner. Description will be given to each part provided in the rear portion of the toy gun 101. The toy gun 101 includes: the trigger 105; a control plate 201 as a rotary member; a control plate rotating cam 202 as a grooved cam; a control plate rotating nail 203; a control plate rotating nail retainer 204 as a trigger action transmission unit; a reverse rotation preventing latch 205; a trigger sear 206; a sear bar 207; and the bolt sear 208.

The trigger 105 is positioned in front of the grip 104. The trigger 105 is supported by the frame 111 so that it can be freely rotated around a fulcrum 105*a* and is extended downward from the frame 111. The trigger 105 can be freely displaced between a firing position 105A for firing bullets and a non-firing position 105B due to the fulcrum 105*a*. (The firing position is the position of the trigger 105 in FIG. 7 and is indicated by an alternate long and short dash line in FIG. 5.) (The non-firing position is the position of the trigger 105 indicated by a solid line in FIG. 5.) The trigger 105 has a portion extended from the fulcrum 105*a* backward of the toy gun 101 and has a mounting stem 105*b* at the tip of this portion. The mounting stem 105*b* rotatably couples together the trigger 105, reverse rotation preventing latch 205 (described later), and trigger sear 206 (described later) A trigger spring 105*c* is placed behind the trigger 105. The trigger spring 105*c* is attached to the frame 111. The trigger spring 105*c* pushes the trigger 105 clockwise and pushes the trigger 105 positioned in the firing position 105A (Refer to FIG. 7) back to the non-firing position 105B.

Figure 6:
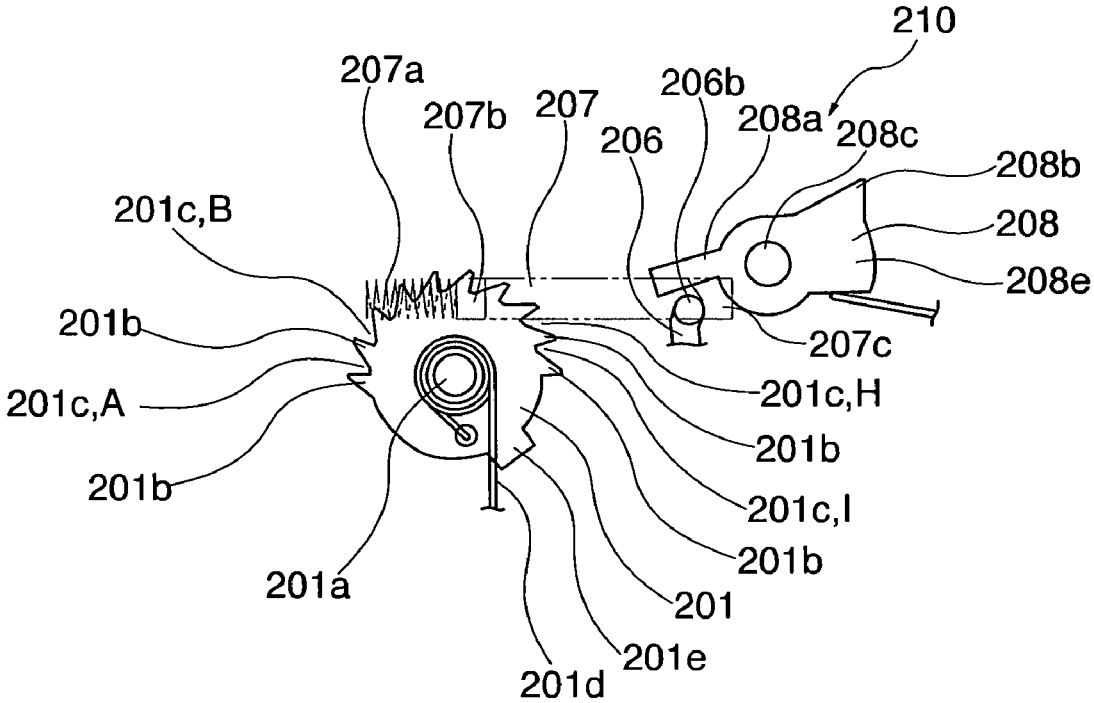
FIG. 6 is a left side view illustrating a control plate and a sear bar.

FIG. 6 is a left side view illustrating the control plate 201 and the sear bar 207. The control plate 201 is positioned in front of and above the trigger 105 in the frame 111. (Refer to FIG. 5.) The control plate 201 is a disk-shaped member. This control plate 201 has a ratchet gear structure comprised of 10 teeth 201*b* in the upper half of its outer circumference. The control plate 201 does not have a tooth 201*b* in the lower half of its outer circumference. This control plate 201 is attached to the frame 111 so that it can be freely rotated around a rotation center shaft 201*a* both in a forward direction and in a backward direction. In the following description, the direction of rotation of the control plate 201 equivalent to counterclockwise direction in FIG. 5 will be designated as forward direction; and the direction of rotation of the control plate 201 equivalent to clockwise direction in FIG. 5 will be designated as backward direction.

In the control plate 201, an interteeth portion 201*c* is formed between teeth 201*b*. The individual interteeth portions 201*c* in FIG. 5 are designated as interteeth portion A, interteeth portion B, . . . , interteeth portion I clockwise from the leftmost. When the control plate 201 is pulled and stopped and positioned in its initial position by a control plate spring 201*d* (described later), various portions are positioned as follows: the interteeth portion A is positioned in a position where the driving pawl 203*b* (Refer to FIG. 5) of the control plate rotating nail 203 (Refer to FIG. 5) is engaged with it; and the interteeth portion D is positioned in a position where the stopper pawl 205*a* (Refer to FIG. 5) of the reverse rotation preventing latch 205 (Refer to FIG. 5) is engaged with it.

The control plate 201 has a sear bar abutment portion 201*e*. The sear bar abutment portion 201*e* is provided on the outer circumference of the control plate 201 in a position adjacent to the 10 teeth 201*b* in the clockwise direction and is protruded toward the direction of a side face of the toy gun 101.

The control plate spring 201*d* as a rotational force supplying portion is wound on the rotation center shaft 201*a*. One end of the control plate spring 201*d* is connected to the inner bottom face 111*a* (Refer to FIG. 5) of the frame 111 (Refer to FIG. 5); and the other end of the control plate spring 201*d* is connected to the control plate 201 between its outer circumference and the rotation center shaft 201*a*. The control plate spring 201*d* pulls the control plate 201 clockwise (backward direction) and supplies the control plate 201, rotated and displaced to the forward direction, with rotational force in the backward direction for returning it to the initial position.

The sear bar 207 is a rod-like member. The sear bar 207 is placed above the trigger 105 in the frame 111. The sear bar 207 is placed in the direction in which it is extended in the back and forth direction of the toy gun 101 and can be freely moved in the back and forth direction of the toy gun 101. A sear bar spring 207*a* for pushing back the sear bar 207 is attached to the front end face of the sear bar 207. The sear bar 207 has a projection 207*b* as an abutted portion at its front end. The projection 207*b* is protruded in the direction of a side face of the toy gun 101. This projection 207*b* is provided in a position where it interferes with the path of the rotation of the sear bar abutment portion 201*e* of the control plate 201. Further, the sear bar 207 has a locking portion 207*c* at its rear end. When the projection 207*b* is pushed by the sear bar abutment portion 201*e* and the sear bar 207 moves forward, this locking portion 207*c* bumps against a pushing-up portion 206*b* (described later) of the trigger sear 206.

Description will be back to FIG. 5. The control plate rotating cam 202 is positioned under the bolt 121 (Refer to FIG. 2) in front of the control plate 201. The control plate rotating cam 202 is attached to the frame 111 so that it can be freely rotated around a rotating shaft 202*a*. The control plate rotating cam 202 is in such a shape that it is extended backward from the rotating shaft 202*a* and has a protruded portion 202*b* on the upper surface of this extended portion. The rotating shaft 202*a* has a control plate rotating cam spring 202*c* wound on it. The control plate rotating cam spring 202*c* pushes the rear part of the control plate rotating cam 202 including the protruded portion 202*b* upward. As a result, the protruded portion 202*b* of the control plate rotating cam 202 is kept in contact with the inner wall of the cam groove 121*c* of the bolt 121. While the bolt 121 makes reciprocating motion in the back and forth direction, the protruded portion 202*b* is pushed by the forward flat portion 121*h*, backward slope 121*i*, and backward flat portion 121*j* of the cam groove 121*c* in this order. As a result, the control plate rotating cam 202 makes reciprocating motion in the vertical direction.

The control plate rotating nail 203 is positioned in front of the control plate 201. The control plate rotating nail 203 is attached to the control plate rotating cam 202 so that it can be freely rotated around a rotating shaft 203*a*. This rotating shaft 203*a* is provided in a position where it hits the lower part of the protruded portion 202*b* of the control plate rotating cam 202. The control plate rotating nail 203 has the driving pawl 203*b* under it. The driving pawl 203*b* faces backward of the toy gun 101 and is in such a shape that it can enter the interteeth portions A to I between teeth 201*b* of the control plate 201. The teeth 201*b* of the control plate 201 form a ratchet gear structure. This causes the following when the bolt 121 moves forward and the control plate rotating nail 203 moves downward: the driving pawl 203*b* that has entered an interteeth portion 201*c* rotates and displaces the control plate 201 in the forward direction. The driving pawl 203*b* that has entered an interteeth portion 201*c* performs the following action even when the bolt 121 moves backward and the control plate rotating nail 203 moves upward: it climbs over a tooth 201*b* of the control plate 201 and enters the next interteeth portion 201*c*. That is, when they are in proximity to one another, the control plate rotating cam 202, control plate rotating nail 203, and bolt 121 make reciprocating motion according to the reciprocating motion of the bolt 121; and during this process, they function as a bolt action transmission unit 212 and rotate and displace the control plate 201 in the forward direction.

The control plate rotating nail 203 has a protruded portion 203*d*, protruded forward and in the direction of a side face of the toy gun 101, under it. The rotating shaft 203*a* has a control plate rotating nail spring 203*c* wound on it. The control plate rotating nail spring 203*c* rotates the control plate rotating nail 203 counterclockwise.

The control plate rotating nail retainer 204 is a member having an L shape as laterally viewed. The control plate rotating nail retainer 204 is placed in an area extended from under the control plate 201 to its front part. One end of the control plate rotating nail retainer 204 is rotatably connected to the trigger 105. The other end of the control plate rotating nail retainer 204 is positioned under the control plate rotating cam 202 and is abutted against the rear face of the protruded portion 203*d* of the control plate rotating nail 203. When a user pulls the trigger 105, the control plate rotating nail retainer 204 slides backward and breaks away from the protruded portion 203*d*. As a result, the driving pawl 203*b* is rotated counterclockwise by the control plate rotating nail spring 203*c* and the driving pawl 203*b* enters an interteeth portion 201*c*.

The reverse rotation preventing latch 205 is positioned above the control plate 201. The reverse rotation preventing latch 205 is a hook-like member having the stopper pawl 205*a* at its front part. The middle part of the reverse rotation preventing latch 205 is supported on the frame 111 through a support shaft 205*b* and can be freely rotated around this support shaft 205*b*. The reverse rotation preventing latch 205 is in such a shape that the following is implemented: when it rotates counterclockwise, the stopper pawl 205*a* can enter the interteeth portions D to I between teeth 201*b* of the control plate 201. As mentioned above, the teeth 201*b* of the control plate 201 form a ratchet gear structure. The stopper pawl 205*a* that has entered an interteeth portion 201*c* is brought into slide contact with a tooth 201*b* of the control plate 201 rotating in the forward direction and enters the next interteeth portion 201*c*. However, the stopper pawl 205*a* that has entered the interteeth portion 201*c* collides with a tooth 201*b* of the control plate 201 rotating in the backward direction and thereby arrests the backward rotation of the control plate 201. Thus the stopper pawl 205*a* and the teeth 201*b* of the control plate 201 form a reverse rotation prevention unit 211.

The stopper pawl 205*a* of the reverse rotation preventing latch 205 enters the following interteeth portion relative to an interteeth portion (for example, the interteeth portion A) where the driving pawl 203*b* of the control plate rotating nail 203 enters: an interteeth portion (the interteeth portion D in this example) positioned with three teeth 201*b* between the driving pawl and it. The reverse rotation preventing latch 205 is coupled to the trigger 105 through the mounting stem 105*b* at a point behind the support shaft 205*b*. For this reason, when a user pulls the trigger 105, the reverse rotation preventing latch 205 rotates counterclockwise and engages the stopper pawl 205*a* with an interteeth portion 201*c*. As mentioned above, the reverse rotation preventing latch 205 functions as a trigger action transmission unit. The lower part of the reverse rotation preventing latch 205 positioned under the mounting stem 105*b* is protruded at two points and a reverse rotation preventing latch spring 205*c* is abutted there. The reverse rotation preventing latch spring 205*c* pushes the reverse rotation preventing latch 205 upward.

The trigger sear 206 is a vertically long member. One end of the trigger sear 206 is rotatably coupled to the trigger 105 by the mounting stem 105*b*. The trigger sear 206 has the pushing-up portion 206*b* on the other end side. When the pushing-up portion 206*b* presses the bolt sear 208 (described later) when the trigger 105 is in the firing position 105A. The pushing-up portion 206*b* breaks away from the bolt sear 208 when the trigger 105 is in the non-firing position 105B. (Refer to FIG. 7.) The mounting stem 105*b* has a trigger sear spring 206*a* wound on it. The trigger sear spring 206*a* pushes the trigger sear 206 clockwise and directs the trigger sear 206 to the vertical direction as illustrated in FIG. 5.

Also when the sear bar 207 (Refer to FIG. 6 as well) moves forward, the pushing-up portion 206*b* of the trigger sear 206 breaks away from the bolt sear 208. When the sear bar 207 moves forward, more specifically, the locking portion 207*c* (Refer to FIG. 6 as well) pushes the pushing-up portion 206*b* forward. As a result, the trigger sear 206 rotates counterclockwise and the pushing-up portion 206*b* breaks away from the bolt sear 208.

The bolt sear 208 is provided above the trigger sear 206 and under the bolt 121 (Refer to FIG. 2) in a position between them. The bolt sear 208 is attached to the frame 111 so that it can be freely rotated around a shaft center 208*c*. The bolt sear 208 includes a flat plate-like forward protruded portion 208*a* and a backward protruded portion 208*e* fanned as laterally viewed. The forward protruded portion 208*a* is protruded forward of the shaft center 208*c*. The backward protruded portion 208*e* is protruded backward of the shaft center 208*c*. The upper part of the backward protruded portion 208*e* is a stopper portion 208*b* for stopping the locking projection 121*f* (Refer to FIG. 2) of the bolt 121. The backward protruded portion 208*e* has a bolt sear spring 208*d* abutted against its under surface. The bolt sear spring 208*d* rotates the bolt sear 208 counterclockwise. When the pushing-up portion 206*b* of the trigger sear 206 pushes the under surface of the forward protruded portion 208*a* upward in this bolt sear 208, the following takes place: the stopper portion 208*b* is displaced downward and the bolt sear 208 is positioned in a permission position 208A. (Refer to FIG. 7.) This permission position 208A refers to a position where the stopper portion breaks away from the path of the movement of the locking projection 121*f* of the bolt 121 and the reciprocating motion of the bolt 121 in the back and forth direction is permitted. Meanwhile, when the trigger sear 206 breaks away from the bolt sear 208, the following takes place: the stopper portion 208*b* is displaced upward by the bolt sear spring 208*d* and the bolt sear 208 is positioned in an arrest position 208B. This arrest position 208B refers to a position where the stopper portion interferes with the path of the movement of the locking projection 121*f* and the reciprocating motion of the bolt 121 is arrested. The bolt sear spring 208*d*, trigger sear 206, sear bar abutment portion 201*e*, sear bar 207, and trigger sear spring 206*a* form a bolt stop unit 210.

Hereafter, description will be given to the action of each part of the toy gun 101 that occurs when a user pulls the trigger 105 with reference to FIG. 2 and FIG. 7 to FIG. 11.

First, description will be given with reference to FIG. 2. A user using the toy gun 101 performs operation of pulling the protruded portion 121*a* backward of the toy gun 101. FIG. 2 depicts the internal structure of the toy gun 101 with the bolt 121 positioned on the rear side of the toy gun 101. When the bolt 121 is positioned backward of the toy gun 101, the forward slope 121*b* of the bolt 121 and the slope 114*b* of the bullet feed plate 114 break away from each other. The bullet feed plate 114 is pushed up by the bullet feed plate spring 115. As a result, the bullet retention hole 114*a* in the bullet feed plate 114 is opposed to the open end 112*d* of the magazine 112. In this state, a bullet B in the magazine 112 is pushed out by the magazine follower 112*c* due to the pushing force of the magazine spring 112*b* and is pushed into the bullet retention hole 114*a* in the bullet feed plate 114.

While the bolt 121 is moving backward, the locking projection 121*f* of the bolt 121 is abutted against the upper surface of the stopper portion 208*b* of the bolt sear 208 and climbs over this stopper portion 208*b*. After the locking projection 121*f* climbs over the stopper portion 208*b*, the bolt sear 208 is rotated counterclockwise by the elastic force of the bolt sear spring 208*d*. At this time, the bolt 121 becomes apt to move forward of the toy gun 101 by the elastic force of the bolt spring 124. However, the locking projection 121*f* of the bolt 121 hitches on the stopper portion 208*b* and does not move forward any more.

As the bolt 121 moves backward, the control plate rotating cam 202 is rotated counterclockwise by the elastic force of the control plate rotating cam spring 202*c* and the protruded portion 202*b* is gradually displaced upward. In conjunction with this displacement, the control plate rotating nail 203 is displaced upward. Then the driving pawl 203*b* of the control plate rotating nail 203 approaches a position where it can be engaged with an interteeth portion 201*c* (interteeth portion A) of the control plate 201.

Figure 7:
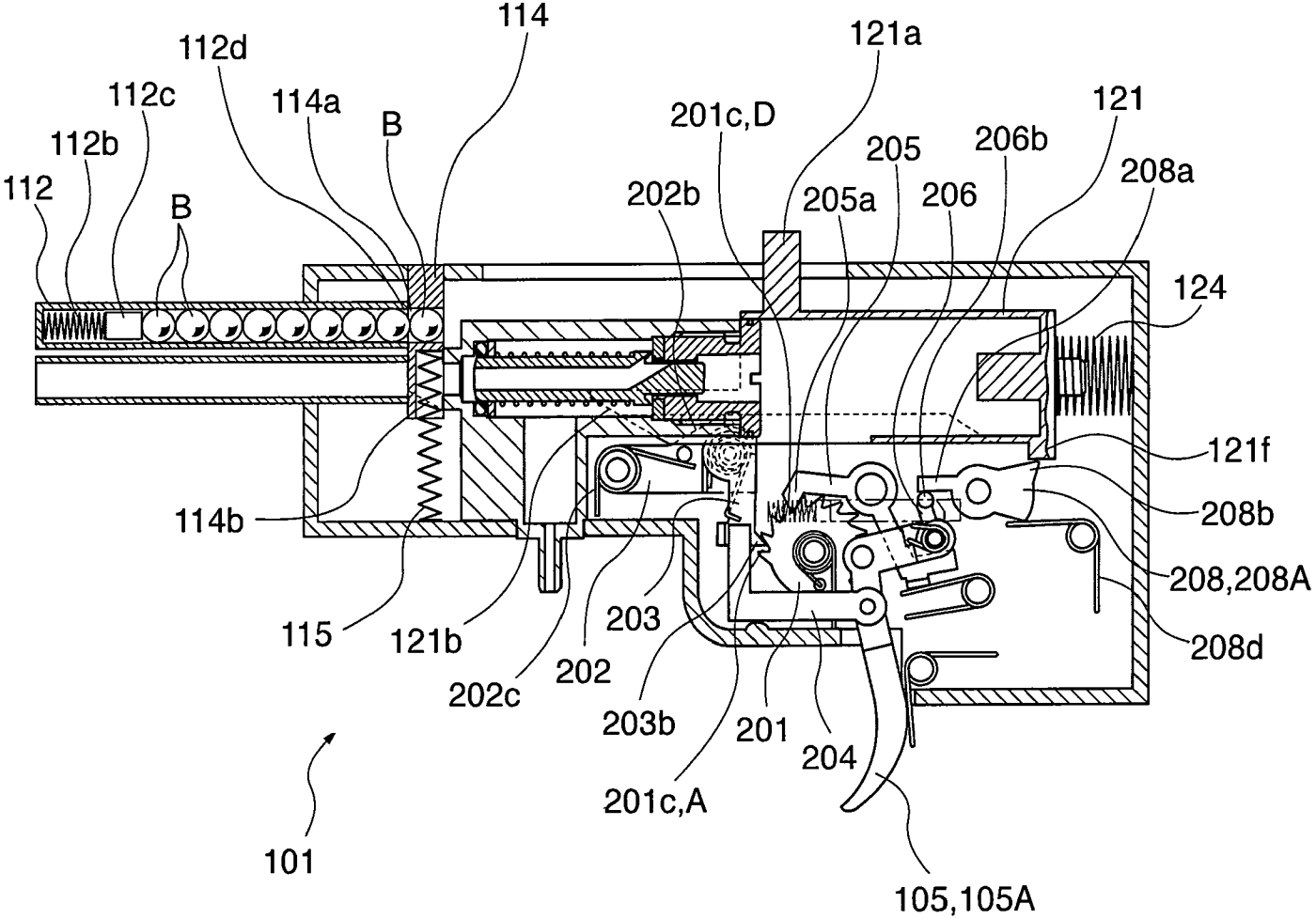
FIG. 7 is a left side view illustrating the internal structure of the toy gun with its trigger pulled, following FIG. 2.

FIG. 7 is a left side view illustrating the internal structure of the toy gun 101 obtained when the trigger 105 is pulled and the trigger 105 is positioned in the firing position 105A, following FIG. 2. When the user pulls the trigger 105 backward, the trigger 105 rotates counterclockwise and displaces the trigger sear 206 upward. The pushing-up portion 206*b* of the trigger sear 206 pushes the under surface of the forward protruded portion 208*a* of the bolt sear 208 upward and rotates the bolt sear 208 clockwise. This removes the engagement between the locking projection 121*f* of the bolt 121 and the stopper portion 208*b* of the bolt sear 208. Thereafter, the bolt 121 is pushed by the bolt spring 124 and moves forward.

When the trigger 105 rotates counterclockwise, the reverse rotation preventing latch 205 is rotated counterclockwise and the stopper pawl 205*a* of the reverse rotation preventing latch 205 enters an interteeth portion 201*c* (interteeth portion D).

When the trigger 105 rotates counterclockwise, the control plate rotating nail retainer 204 is moved backward. In conjunction with this movement, the driving pawl 203*b* of the control plate rotating nail 203 enters an interteeth portion 201*c* (interteeth portion A) of the control plate 201.

Figure 8:
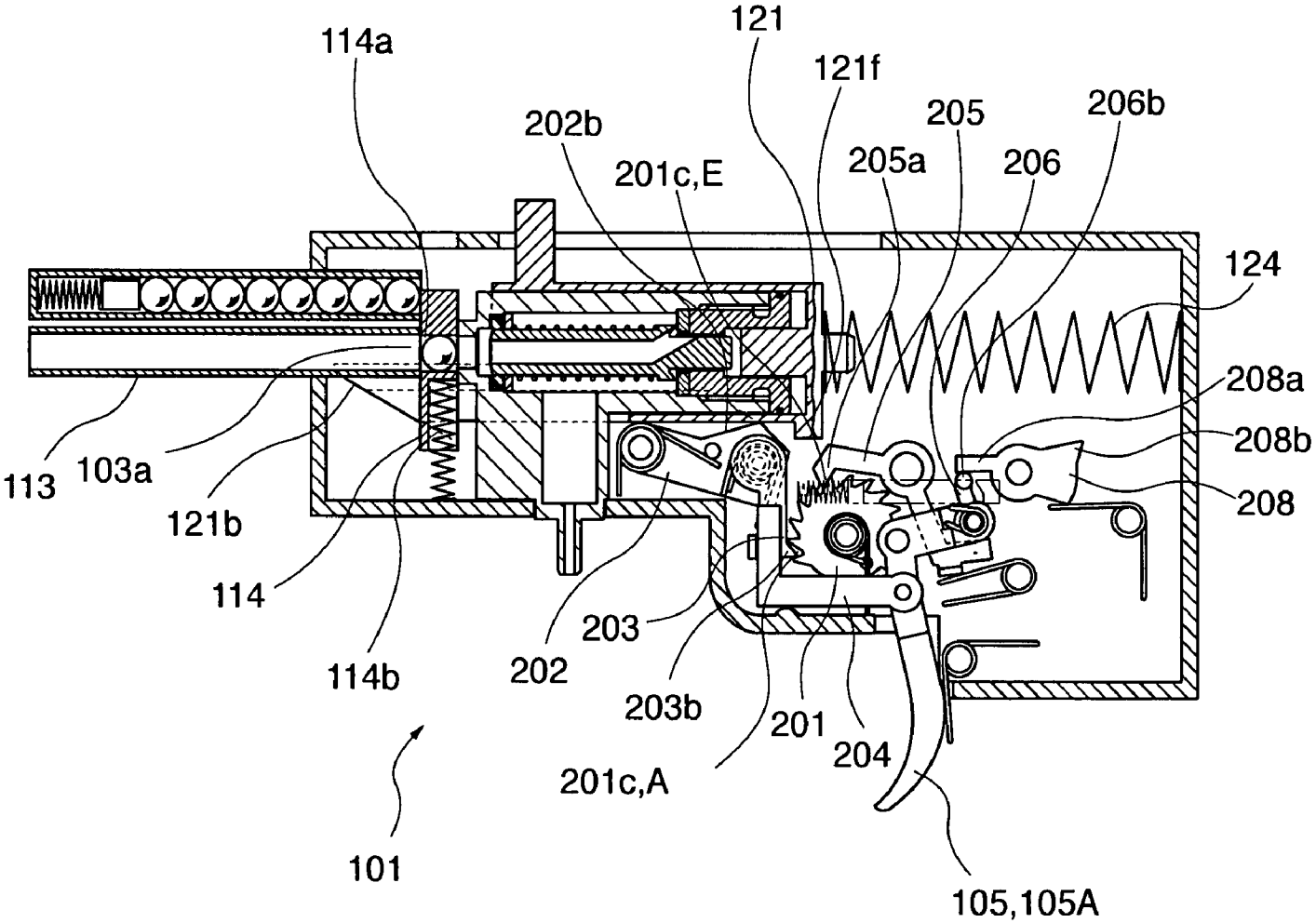
FIG. 8 is a left side view illustrating the internal structure of the toy gun with its bolt moved forward, following FIG. 7.

FIG. 8 is a left side view illustrating the internal structure of the toy gun 101 with the bolt 121 moved forward, following FIG. 7. When the bolt 121 moves forward, the under surface of the forward slope 121*b* slides so that it climbs over the slope 114*b* of the bullet feed plate 114 and pushes the bullet feed plate 114 downward. When the bullet feed plate 114 comes down, the bullet retention hole 114*a* in the bullet feed plate 114 is positioned in the position where it is opposed to the open end 103*a* of the barrel 113.

At this time, the protruded portion 202*b* of the control plate rotating cam 202 is abutted against the inner wall of the cam groove 121*c* of the bolt 121. For this reason, as the bolt 121 moves forward, the control plate rotating cam 202 is displaced downward and pushes the control plate rotating nail 203 downward. Then the driving pawl 203*b* of the control plate rotating nail 203 rotates the control plate 201 in the forward direction (counterclockwise). As the result of this rotation of the control plate 201, the stopper pawl 205*a* of the reverse rotation preventing latch 205 gets out of the interteeth portion D and slides along a tooth 201*b*. Then it enters the interteeth portion E adjoining to the interteeth portion D in the clockwise direction.

Figure 9:
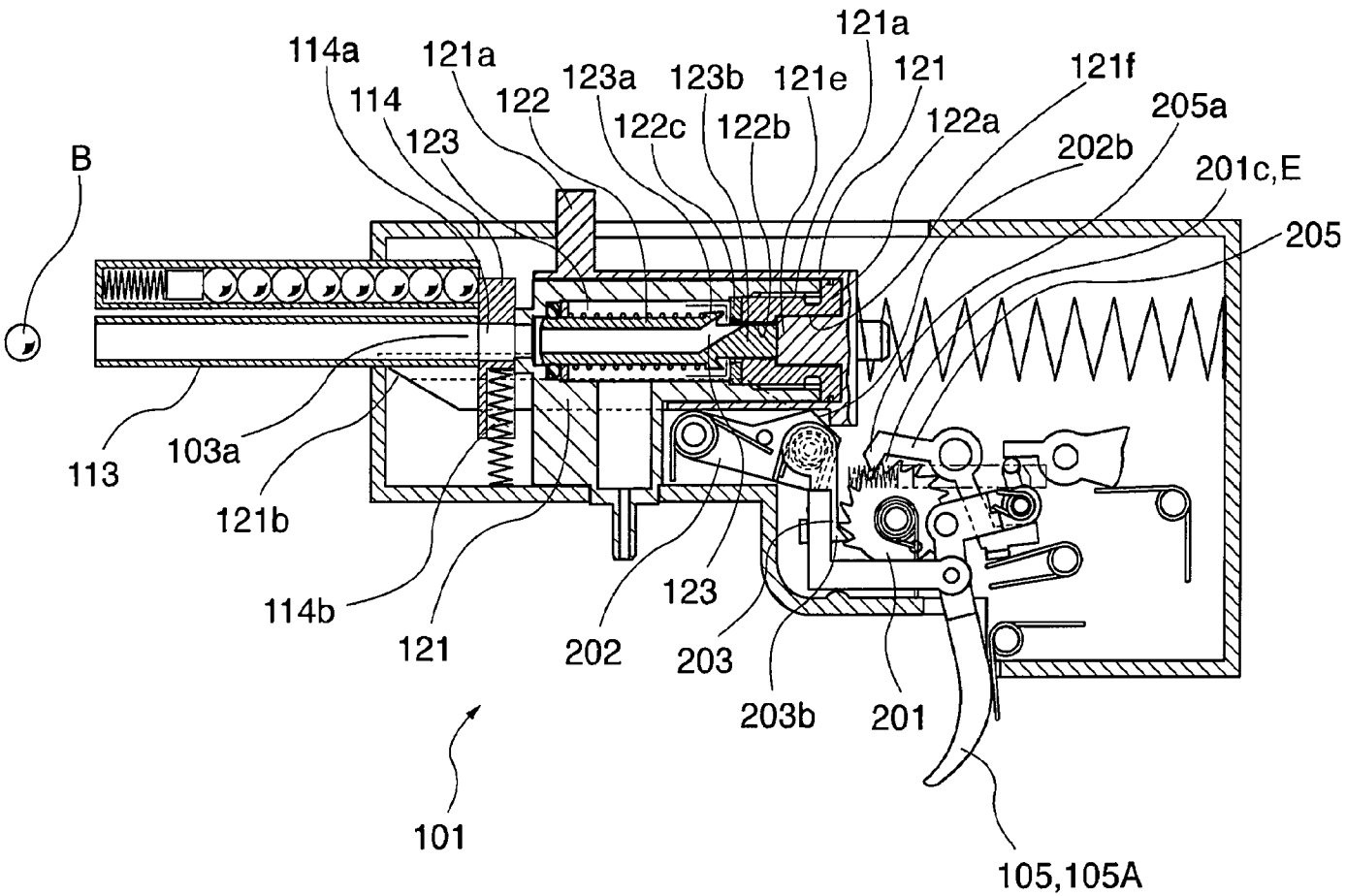
FIG. 9 is a left side view illustrating the internal structure of the toy gun with its slide projection pushed, following FIG. 8.

FIG. 9 is a left side view illustrating the internal structure of the toy gun 101 obtained when the fitting projection 121*e* pushes the slide projection 123*b*, following FIG. 8. When the bolt 121 further advances, the fitting projection 121*e* enters the fitting hole 122*f* in the rear lid 122*a* and pushes the slide projection 123*b* of the discharge valve 123 forward. This causes the flange portion 123*a* of the discharge valve 123 to break away from the packing 122*c*. Compressed gas goes forward through the space in the valve body 122 and flows to the bullet retention hole 114*a* in the bullet feed plate 114. At this time, the bullet B is positioned in the position where it is opposed to the open end 103*a* of the barrel 113. The compressed gas flowing and coming forward of the valve body 122 hits the rear side face of the bullet B. Receiving the pressure of the compressed gas, the bullet B moves forward in the barrel 113 and is shot out of the muzzle 103. When the flange portion 123*a* and the packing 122*c* break away from each other, the compressed gas also pushes the bolt 121 backward.

Figure 10:
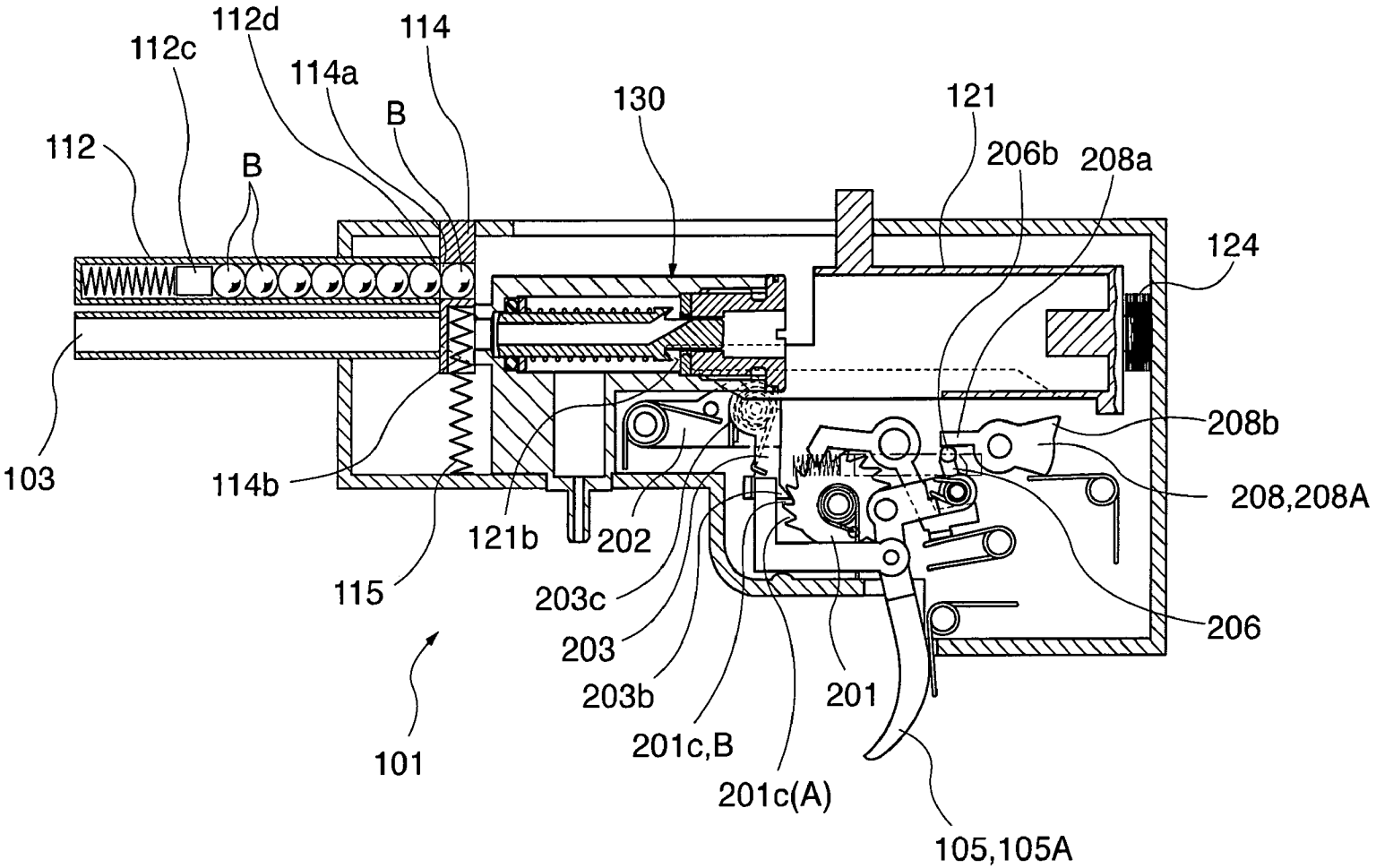
FIG. 10 is a left side view illustrating the internal structure of the toy gun with the bolt moved backward, following FIG. 9.

FIG. 10 is a left side view illustrating the internal structure of the toy gun 101 with the bolt 121 moved backward, following FIG. 9. When the bolt 121 is pushed by the pressure of compressed gas and moves backward, the forward slope 121*b* of the bolt 121 and the slope 114*b* of the bullet feed plate 114 break away from each other. Consequently, the bullet feed plate 114 is pushed upward by the bullet feed plate spring 115. As a result, the bullet retention hole 114*a* is positioned in the position where it is opposed to the open end 112*d* of the magazine 112. A bullet B is pushed by the magazine follower 112*c* and enters the bullet retention hole 114*a*.

When the bolt 121 is pushed by the pressure of compressed gas and is moved backward, the control plate rotating cam 202 moves upward. In conjunction with this movement of the control plate rotating cam 202, the driving pawl 203*b* of the control plate rotating nail 203 gets out of the interteeth portion A of the control plate 201. Then it slides on a tooth 201*b* and is caused to enter the interteeth portion B by the control plate rotating nail spring 203*c*.

While the user pulls and positions the trigger 105 in the firing position 105A and keeps it there, the forward protruded portion 208*a* of the bolt sear 208 is kept pushed up by the pushing-up portion 206*b* of the trigger sear 206. As a result, the stopper portion 208*b* of the bolt sear 208 moves down. That is, the bolt sear 208 is positioned in the permission position 208A. As a result, the bolt 121 is not stopped by the bolt sear 208 and moves backward as far as it will go. Then it is pushed by the bolt spring 124 and starts to advance in turn. Thus the bolt 121 receives the elastic force of the bolt spring 124 and the pressure of compressed gas and makes reciprocating motion. While it reciprocates once, it opens and closes the valve portion 130. In the toy gun 101 in this embodiment, the bolt 121 repeats the reciprocating motion in the back and forth direction, described with reference to FIG. 2 and FIG. 7 to FIG. 10, six times when the trigger 105 is kept pulled. Then the toy gun 101 fires off six bullets B from the muzzle 103 in rapid succession.

In the toy gun 101 in this embodiment, the valve portion 130 is opened and closed each time one bullet B is fired off. For this reason, the user can feel impact arising from firing each time a bullet B is fired off. The bullet B is shot out of the muzzle 103 by the pressure of compressed gas. For this reason, the sense of use of the burst toy gun 101 is close to that of a real gun and the user of this toy gun 101 can feel as if he/she used a real gun.

Figure 11:
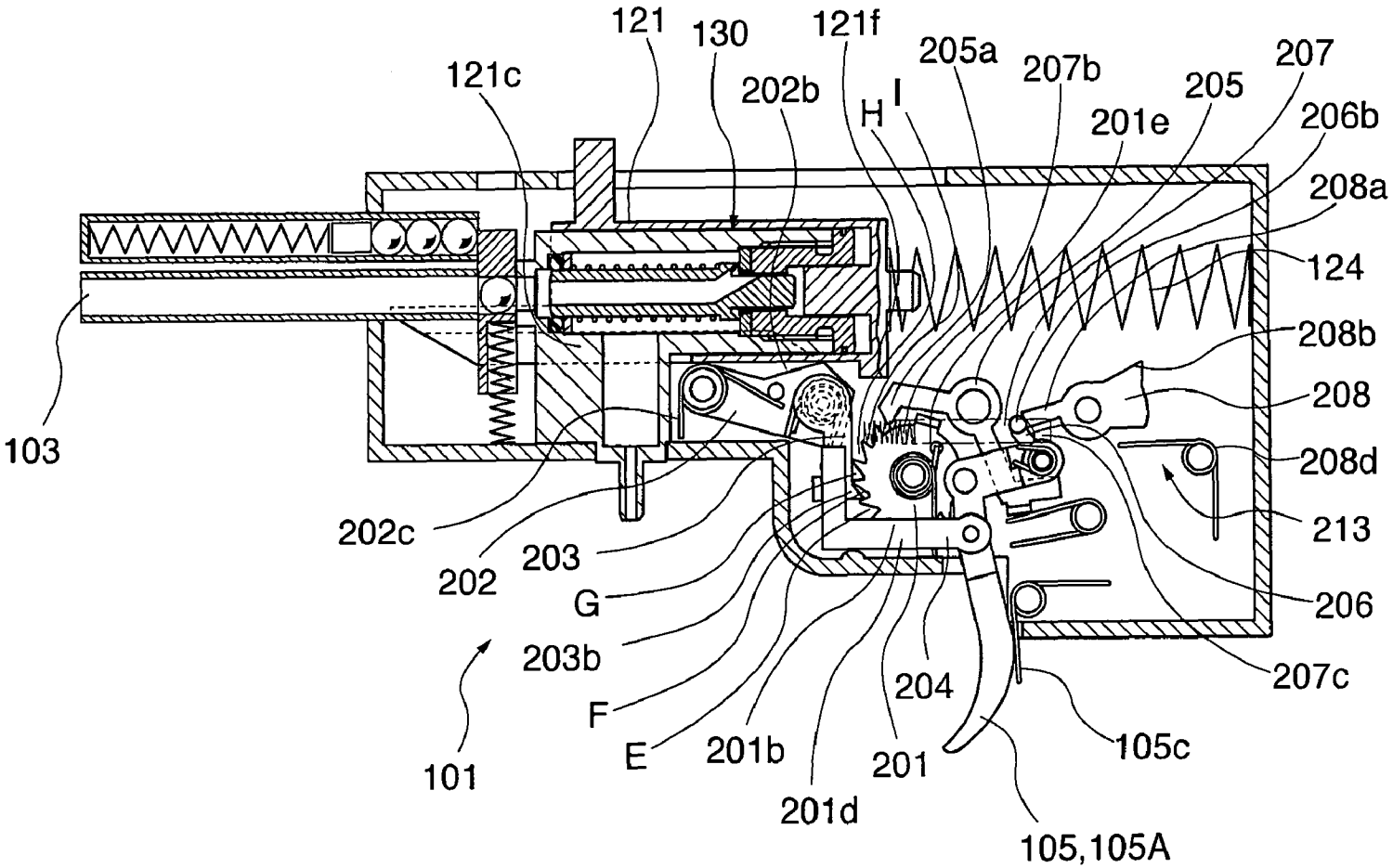
FIG. 11 is a left side view illustrating the internal structure of a toy gun immediately before the sixth bullet is fired off.

FIG. 11 is a left side view illustrating the internal structure of the toy gun 101 obtained immediately before the sixth bullet B is fired off. Each time a bullet B is fired off from the muzzle 103 and the control plate 201 rotates counterclockwise, the reverse rotation preventing latch 205 performs the following action: it climbs over a tooth 201*b* of the control plate 201 and enters the interteeth portion E, interteeth portion F, interteeth portion G, interteeth portion H, and interteeth portion I in this order and eventually gets out of the interteeth portion I. When the driving pawl 203*b* of the control plate rotating nail 203 is thereafter displaced downward and further rotates the control plate 201 in the forward direction (counterclockwise direction), the following takes place: the sear bar abutment portion 201*e* bumps into the projection 207*b* of the sear bar 207 and moves the sear bar 207 forward. When the sear bar 207 moves forward, the locking portion 207*c* of the sear bar 207 pushes the pushing-up portion 206*b* of the trigger sear 206 forward and rotates the trigger sear 206 counterclockwise. By this rotation, the pushing-up portion 206*b* slides on the under surface of the forward protruded portion 208*a* of the bolt sear 208 and breaks away from the bolt sear 208. As a result, the bolt sear 208 is rotated counterclockwise by the bolt sear spring 208*d* and the stopper portion 208*b* is displaced upward.

When the bolt 121 moves backward as far as it will go in this state after the firing of the sixth bullet B, the stopper portion 208*b* of the bolt sear 208 interferes with the locking projection 121*f* of the bolt 121 pushed and caused to advance by the bolt spring 124. As a result, the bolt 121 comes to rest. When the user removes his/her finger from the trigger 105 at this time, the trigger spring 105*c* rotates the trigger 105 clockwise and positions the trigger 105 in the non-firing position 105B. (Refer to FIG. 2.) By this forward movement of the trigger 105, the reverse rotation preventing latch 205 is rotated clockwise. At this time, the stopper pawl 205*a* of the reverse rotation preventing latch 205 breaks away from the control plate 201. By the forward movement of the trigger 105, further, the control plate rotating nail retainer 204 is displaced forward. At this time, the protruded portion 202*b* of the control plate rotating cam 202 ascends along the inner wall of the cam groove 121*c* of the bolt 121. As a result, the control plate rotating cam 202 is rotated counterclockwise by the control plate rotating cam spring 202*c* and the driving pawl 203*b* breaks away from the control plate 201. When the stopper pawl 205*a* and the driving pawl 203*b* break away from the control plate 201, the control plate 201 is rotated in the backward direction (clockwise) by the tension of the control plate spring 201*d*. Then it returns to the state illustrated in FIG. 2.

When the user removes his/her finger from the trigger 105 before the toy gun 101 has fired all the six bullets, the trigger spring 105*c* positions the trigger 105 in the non-firing position 105B and the trigger 105 rotates clockwise. As the result of this rotation, the trigger sear 206 breaks away from the bolt sear 208. The bolt sear 208 is pushed by the bolt sear spring 208*d* and is rotated clockwise. As a result, the bolt sear 208 is displaced from the permission position 208A to the arrest position 208B. When the bolt 121 moves backward as far as it will go in this state, the stopper portion 208*b* interferes with the locking projection 121*f* even though the bolt spring 124 pushes the bolt 121 forward. That is, the bolt 121 is stopped.

The bolt sear spring 208*d*, trigger sear 206, sear bar abutment portion 201*e*, sear bar 207, and trigger sear spring 206*a* position the bolt sear 208 in the arrest position 208B according to at least either of the following: the displacement of the trigger 105 to the non-firing position 105B and the rotational displacement of the control plate 201 from the initial position due to a predetermined number of times of the reciprocating motion of the driving pawl 203*b*. The bolt sear spring 208*d*, trigger sear 206, sear bar abutment portion 201*e*, sear bar 207, and trigger sear spring 206*a* form a bolt stop unit 213.

In the toy gun 101 in this embodiment, as mentioned above, the following takes place when a user pulls the trigger 105: the bolt stop unit 213 reciprocates by a predetermined number of times to open and close the valve portion 130 in rapid succession and thereafter the bolt stop unit 213 arrests the reciprocating motion of the bolt. Thus a burst of gunfire is accomplished without use of a battery.

In a toy gun using compressed gas, in general, the compressed gas cools the entire toy gun when bullets are continuously fired off. When the toy gun is cooled, the expansion force of gas is reduced and this prevents bullet firing and blowback from normally occurring. In the toy gun 101 in this embodiment, however, a limited number of bullets are continuously fired off. This suppresses the toy gun 101 from being cooled by the compressed gas. For this reason, the toy gun 101 in this embodiment is less prone to malfunction and the toy gun can be used for a long time.

Obviously, numerous modifications and variations of the present invention are possible in light of the above teachings. It is therefore to be understood that within the scope of the appended claims, the invention may be practiced otherwise than as specifically described herein.

What is claimed is:

1. A burst toy gun comprising:

a trigger so provided that the trigger can be freely displaced between a firing position for firing off a bullet and a non-firing position;

a valve portion opening and closing an area where a barrel and an air chamber filled with compressed gas communicate with each other, the valve portion including a valve body and a discharge valve slidably disposed inside the valve body and movable to and between a valve opened state and a valve closed state;

a bolt slidably provided, making reciprocating motion upon receiving power supplied by a power supplying portion, and opening and closing the valve portion while the bolt reciprocates once, the bolt defining a bolt hole sized to receive the valve body and slide along the valve body as the bolt is in reciprocating motion;

a bolt sear so provided that the bolt sear can be freely displaced between an arrest position where the reciprocating motion of the bolt is arrested and a permission position where this reciprocating motion is permitted;

a rotary member so provided that the rotary member can be freely rotated both in a forward direction and in a backward direction;

a reverse rotation prevention unit provided so that the reverse rotation prevention unit can freely come close to and break away from the rotary member, and permitting the rotation of the rotary member in the forward direction and arresting the rotation in the backward direction when the reverse rotation prevention unit is close to the rotary member;

a rotational force supplying portion supplying the rotary member rotationally displaced in the forward direction with rotational force in the backward direction for returning the rotary member to an initial position;

a bolt action transmission unit provided so that the bolt action transmission unit can freely come close to and break away from the rotary member, making reciprocating motion according to the reciprocating motion of the bolt when the bolt action transmission unit is close to the rotary member, and rotationally displacing the rotary member in the forward direction during this process;

a trigger action transmission unit causing the reverse rotation prevention unit and the bolt action transmission unit to come close to the rotary member according to displacement of the trigger to the firing position and causing the reverse rotation prevention unit and the bolt action transmission unit to break away from the rotary member according to displacement of the trigger to the non-firing position; and a bolt stop unit positioning the bolt sear in the permission position according to displacement of the trigger to the firing position and positioning the bolt sear in the arrest position according to at least either of displacement of the trigger to the non-firing position and rotational displacement of the rotary member from the initial position due to a predetermined number of times of the reciprocating motion of the bolt action transmission unit.

2. The burst toy gun of claim 1, wherein:

the rotary member has a ratchet gear structure, the reverse rotation prevention unit includes a stopper pawl engaged with the rotary member, the bolt action transmission unit includes:

a driving pawl engaged with the rotary member in a place different from the place where the reverse rotation prevention unit is engaged, and a grooved cam abutted against a side face of the bolt and moving the driving pawl in conjunction with the bolt, the bolt sear is rotatably provided, and the bolt stop unit includes:

a bolt sear spring rotating the bolt sear toward the arrest position, a trigger sear one end of which is rotatably coupled to the trigger and the other end of which presses the bolt sear in the direction in which the bolt sear is rotated to the permission position when the trigger is in the firing position and breaks away from the bolt sear when the trigger is in the non-firing position, a sear bar abutment portion provided in the rotary member, a sear bar having an abutted portion against which the sear bar abutment portion is abutted and rotating the trigger sear when pushed by the sear bar abutment portion and causing the other end of the trigger sear to break away from the bolt sear, and a trigger sear spring rotating the trigger sear in the direction opposite the direction of the rotation by the sear bar.

3. The burst toy gun of claim 1, wherein:

when the reciprocating motion of the bolt is permitted, the bolt slides over the valve body to eventually contact the discharge valve thereby causing the discharge valve to move from the valve closed state to the valve opened state.

* * * * *